United States Patent [19]

Pankowiecki et al.

[11] Patent Number: 4,917,570

[45] Date of Patent: Apr. 17, 1990

[54] TURBINE SHAFT AXIAL LOAD PROTECTION SYSTEM

[75] Inventors: Joseph Pankowiecki, Casselberry; Andrew S. Braytenbah; Gilbert F. Hyde, both of Winter Springs, all of Fla.

[73] Assignee: Westinghouse Electric Corp., Pittsburgh, Pa.

[21] Appl. No.: 193,697

[22] Filed: May 13, 1988

[51] Int. Cl.[4] ..... F01D 3/00

[52] U.S. Cl. ..... 415/104; 415/28; 60/657; 137/569

[58] Field of Search ..... 415/144, 145, 28, 1, 415/104, 106, 107, 95; 60/657, 646, 663; 137/569

[56] References Cited

U.S. PATENT DOCUMENTS

| | | | |
|---|---|---|---|
| 879,748 | 2/1908 | Curtis | 415/104 |
| 1,011,826 | 12/1911 | London | 415/95 |

FOREIGN PATENT DOCUMENTS

| | | | |
|---|---|---|---|
| 675253 | 4/1939 | Fed. Rep. of Germany | 415/106 |
| 165801 | 9/1984 | Japan | 415/104 |
| 324496 | 11/1957 | Sweden | 415/106 |

*Primary Examiner*—Robert E. Garrett
*Assistant Examiner*—John T. Kwon
*Attorney, Agent, or Firm*—K. Bach

[57] ABSTRACT

An axial thrust limiting system for a steam turbine including a rotor having a shaft, the turbine containing a plurality of chambers each defining a pressure zone containing a fluid which, during operation of the turbine, is at a pressure which influences the axial thrust load on the shaft, the turbine being constructed such that at least during rapid shut down a pressure differential can develop between two of the chambers to create an excessive axial thrust load on the shaft. The axial thrust limiting system includes controllable valve connected in a fluid flow path between the two chambers, and valve operating components connected for operating the valves during rapid shut down of the turbine in order to reduce the pressure differential between the two chambers.

11 Claims, 1 Drawing Sheet

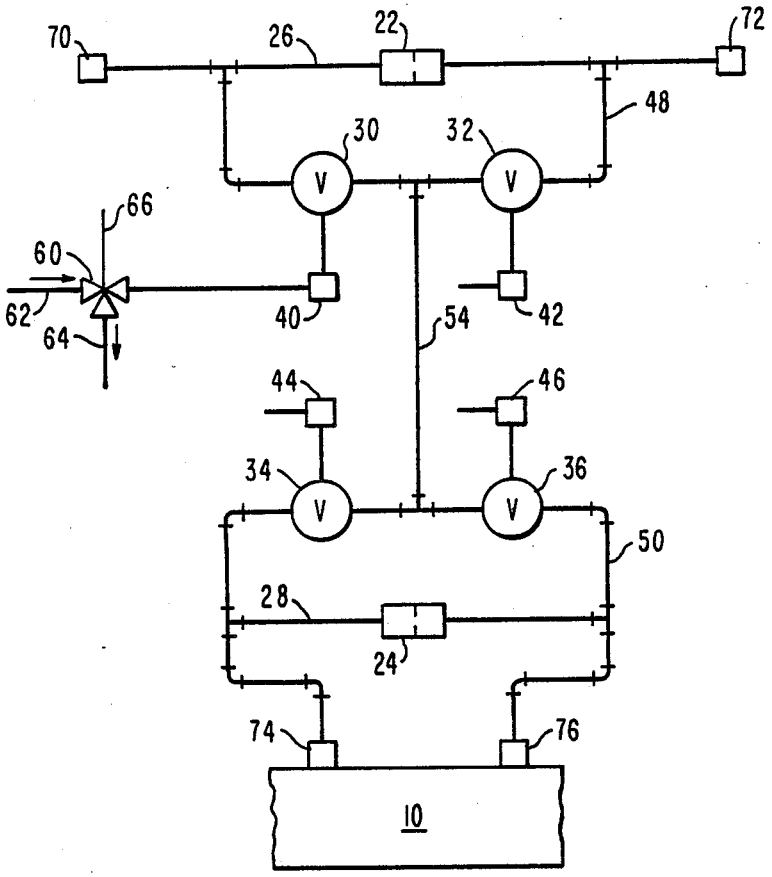
70
26
22
72
48
30
32
V
V
66
60
62
64
40
42
54
44
46
34
36
V
V
50
28
24
74
76
10

TURBINE SHAFT AXIAL LOAD PROTECTION SYSTEM

BACKGROUND OF THE INVENTION

The present invention relates to the protection of turbine shafts against excessive axial thrust loads, particularly during emergency shutdown or trip conditions.

The interior of a turbine is composed of a plurality of chambers which may be separated from one another by groups of rotor blades, rotor discs, and seals of various types, such as rotor labyrinth seals which have stepped diameters. The pressures in these chambers have varying values, due, for example, to pressure and fluid flow velocity differences across rotor blades and pressure differentials across rotor discs and rotor seals. Each of these differentials may act in one axial direction or the other, and their sum determines the net axial thrust imposed on the rotor shaft.

Turbines are normally designed so that the axial pressure load acting on the rotor is essentially balanced, this being achieved primarily by proper choice of labyrinth seal diameters. Any residual axial thrust loads are supported by a thrust bearing. In general, steps must be taken to assure that the axial rotor thrust remains below a given level because an excessive axial thrust can overload the thrust bearing and lead to serious machine damage.

Since the pressures in the various chambers vary over the turbine load range, limitations imposed by the rotor geometry of certain turbines can create an obstacle to maintenance of an acceptable net axial thrust.

It has been found that, for many types of turbines, this problem can be alleviated by redistributing the pressures acting on the rotor. This may be done, for example, by interconnecting certain chambers, or cylinder pressure zones, by means of equilibrium pipes containing flow restricting orifices. Appropriate sizing of such orifices can then produce a pressure distribution suitable to maintain a low steady state net rotor thrust.

However, this solution has been found to be effective only when the turbine is in normal operation and if a turbine must be rapidly shut down, as in the case of an emergency shutdown, the pressure distribution established during normal operation can be substantially altered and can result in an excessive axial load on the thrust bearing.

SUMMARY OF THE INVENTION

It is an object of the present invention to provide a system which minimizes the axial thrust exerted by a rotor on its thrust bearing when the pressure conditions within the turbine change abruptly, as during an emergency shutdown operation.

Another object of the invention is to provide an axial thrust limiting system which will not adversely affect normal turbine operation.

Yet another object of the invention is to provide an axial thrust limiting system which will have a high degree of operating reliability.

The above and other objects are achieved, in accordance with the present invention, in a system composed of a steam turbine including a rotor having a shaft, the turbine containing a plurality of chambers each defining a pressure zone containing a fluid which, during operation of the turbine, is at a pressure which influences the axial thrust load on the shaft, the turbine being constructed such that at least during rapid shut down a pressure differential can develop between two of the chambers to create an excessive axial thrust load on the shaft, by the improvement comprising controllable valve means connected in a fluid flow path between the two chambers, and valve operating means connected for operating the valve means during rapid shut down of the turbine in order to reduce the pressure differential between the two chambers.

BRIEF DESCRIPTION OF THE DRAWING

FIG. 1 is a schematic diagram of a preferred embodiment of a protective system according to the present invention.

DESCRIPTION OF THE PREFERRED EMBODIMENTS

FIG. 1 illustrates one preferred embodiment of a pressure redistributing system according to the present invention. The illustrated embodiment could be employed, for example, to protect an HP-IP turbine unit. The embodiment illustrated in FIG. 1 is connected to a turbine unit 10 which is provided with equilibrium pipe orifices 22 and 24 installed in equilibrium pipes 26 and 28, respectively, each of pipes 26 and 28 being connected between two cylinder pressure zones, or chambers, within turbine unit 10. As a general rule, pipes 26 and 28 are connected between the same two pressure zones. Orifices 22 and 24 serve, as noted earlier herein, to redistribute pressures acting on the turbine rotor during normal turbine operation in order to maintain the axial thrust on the rotor shaft at an acceptable level.

If it should be necessary to subject turbine 10 to a rapid shutdown operation, the pressure distribution between the two chambers connected by pipes 26 and 28 will be upset to a significant extent and will result in excessive axial rotor thrust on the associated thrust bearing.

In order to eliminate this reaction to the shutdown operation, the present invention provides a series arrangement of two thrust balance valves 30 and 32 across orifice 22 and a similar series arrangement of thrust balance valves 34 and 36 across orifice 24. Each of valves 30, 32, 34 and 36 is a pneumatically actuated, two-position valve which can be switched between a fully closed state and a fully open state under control of a respective actuator 40, 42, 44, or 46. Each pair of valves 30, 32 and 34, 36 is connected in a respective conduit 48 or 50 connected to piping 26 or 28 so as to be in parallel with a respective one of orifices 22 and 24.

A balance line 54 is connected between conduits 48 and 50, each end of balance line 54 being connected between the valves 30, 32, or 34, 36 disposed in the respective conduit.

Each of actuators 40, 42, 44 and 46 may be a pneumatically operated device connected to a source of air under pressure via a three-way solenoid valve, one such valve 60 being shown associated with actuator 40. Valve 60 is connected to a source of air under pressure via a line 62 and to the atmosphere via a line 64. Valve 60 is actuatable by an electrical signal applied via an input line 66. In a complete device, a solenoid valve similar to valve 60 will be connected to each of the other actuators 42, 44 and 46.

Each end of each equilibrium pipe 26, 28 is placed in communication with the respective one of the two cylinder pressure zones by a suitable coupling member 70, 72, 74 and 76. Typically, coupling members 70 and 74 will be placed in communication with one of the two cylinder zones each containing fluid at a certain pressure, while coupling members 72 and 76 will be placed in communication with the other one of the two cylinder zones. In most cases, each cylinder zone will extend entirely around the turbine rotor shaft and the two coupling members communicating with a given zone will be spaced apart in the circumferential direction in order to cause the effect of orifices 22 and 24, as well as of valves 30, 32, 34 and 36, to have a more uniform effect within each zone.

In some systems, turbine unit 10 may be associated with four equilibrium pipes, each containing a respective orifice, in order to achieve an even more uniform effect on the pressures within the associated zones and to allow for use of smaller diameter pipes. However, even in an arrangement of this type, it is believed that only two groups of thrust balance valves need be provided.

According to a preferred embodiment of the invention, each solenoid valve 60 is connected so that the application of a defined electrical signal to input conductor 66 will establish communication between pressure source line 62 and actuator 40, while the disappearance of the electrical signal from conductor 66 will establish communication between atmospheric pressure line 64 and actuator 40. Correspondingly, each actuator 40 is constructed so that when exposed to atmospheric pressure, or possibly some higher pressure which is less than that normally supplied via line 62, the associated thrust balance valve will be permitted to open. Thus, both solenoid valve 60 and each actuator 40, 42, 44 and 46 is connected to operate as a fail open device.

To provide further redundancy, line 62 can be connected to a pressure source via a further valve (not shown) which will place line 62 in communication with the atmosphere if solenoid valve 60 does not open when the electrical energizing signal disappears from conductor 66. This will provide additional assurance of opening of the associated thrust balance valve at the desired time.

During normal operation of a turbine equipped with the protective system according to the invention, an electrical energizing signal is applied to the input conductor 66 of each solenoid valve 60, so that each thrust balance valve 30, 32, 34 and 36 remains closed. Thus, normal pressure conditions are maintained in the turbine pressure zones which are coupled together via orifices 22 and 24. When turbine 10 is to undergo rapid shutdown, this will be triggered by an output signal from a sensor or by the actuation of a switch, either of which operation will serve, via suitable switching circuitry, to remove the electrical signal from the input conductor 66 of each solenoid valve 60. Then all thrust balance valves 30, 32, 34 and 36 will open, resulting in a significant reduction in the pressure differential between the two cylinder zones coupled to orifices 22 and 24. As a result, during this rapid shutdown operation, excessive axial shaft thrust loads will be prevented from developing.

In theory, this protective operation could be performed by means of a single thrust balance valve connected in parallel with one equilibrium pipe orifice if total operating reliability of the single thrust balance valve could be assumed.

However, since no mechanical component can be considered absolutely immune from malfunction, and because failure of the protective system according to the invention could result in substantial turbine damage, preferred embodiments of the invention employ a plurality of thrust balance valves connected to provide a degree of redundancy which will assure the required operating reliability.

This goal could be partially met by providing two thrust balance valves in parallel. However, while this would protect against a malfunction which causes one of the thrust balance valves to remain closed, it would offer no protection against a malfunction which results in premature opening of one of the valves. If the bypass path provided according to the invention across one of the orifices 22, 24 should become open during normal turbine operation, the resulting pressure unbalance could place an excessive axial thrust load on the shaft thrust bearing.

Similarly, if redundancy were to be provided by connecting two thrust balance valves in series, a malfunction resulting in the failure of one of the valves to open when rapid shutdown is occurring would not be overcome.

Taking these considerations into account, preferred embodiments of the invention employ at least four thrust balance valves arranged in two groups, with the valves of each group being connected together in series across a respective orifice 22, 24 and the point of connection between the two thrust balance valves of each group being connected together by balance line 54. With this arrangement, proper operation will be assured, both under normal operating conditions and during rapid shut down, even if any one valve should open during normal operation or fail to open during rapid shut down.

Specifically, if any one thrust balance valve should open during normal operation, both conduits 48 and 50 will remain blocked by the other thrust balance valves. Conversely, if any one thrust balance valve should remain closed during rapid shutdown, an alternative pressure equalization path will be established via balance line 54.

Furthermore, the preferred valve arrangement according to the invention makes possible the testing of the opening function of each valve individually during normal turbine operation since, as noted above, the opening of a single thrust balance valve will not have any influence on the pressure conditions within the turbine.

The invention can be applied to any turbine having two pressure zones between which a pressure differential is to be maintained during normal operation and between which pressure equalization should be created during rapid shutdown. By way of example, an arrangement having the form illustrated in the Figure has been successfully installed on a model BB-243 HP-IP turbine manufactured by the Westinghouse Electric Corporation of Pittsburgh, Pennsylvania. This turbine is equipped with four equilibrium pipes each provided with a respective orifice, with one end of each pipe being connected to communicate with the low pressure dummy leak-off zone of the turbine, located at the governor end of the turbine, and the other end of each equilibrium pipe being connected to communicate with the IP turbine exhaust chamber disposed at the generator end of the turbine. At each end of the turbine, the equilibrium pipes were distributed around the circumference thereof in order to promote uniform pressure conditions throughout each zone, or chamber.

What is claimed is:

1. In a system composed of a steam turbine including a rotor having a shaft, the turbine containing a plurality of chambers each defining a pressure zone containing a fluid which, during operation of the turbine, is at a pressure which influences the axial thrust load on the shaft, the turbine being constructed such that at least during rapid shut down a pressure differential can develop between two of the chambers to create an excessive axial thrust load on the shaft, the improvement comprising controllable valve means connected in a fluid flow path between the two chambers, and valve operating means connected for operating said valve means during rapid shut down of the turbine in order to reduce the pressure differential between the two chambers, wherein said valve means comprise: two valve units each connected between the two chambers and each composed of two controllable valves connected together in series; and a pressure balance line connected between said two valve units and connected to each said valve unit at a location between said two controllable valves of said unit, for establishing a low resistance fluid flow path among said controllable valves of said two units.

2. A system as defined in claim 1 further comprising two conduits each containing a flow control orifice connected to form a fluid flow path between the two turbine chambers in parallel with a respective one of said valve units.

3. A system as defined in claim 1 wherein said valve operating means are coupled to said controllable valves and operable for maintaining said controllable valves closed during normal turbine operation and for opening all of said controllable valves upon initiation of rapid shut down of the turbine.

4. A system as defined in claim 3 further comprising two conduits each containing a flow control orifice connected to form a fluid flow path between the two turbine chambers in parallel with a respective one of said valve units.

5. A system as defined in claim 3 wherein said valve operating means comprise, for each said controllable valve, a pneumatic actuator coupled to the respective controllable valve, and an electrically operated three-way solenoid valve having an electrical signal input, a first port communicating with a source of air under pressure, a second port communicating with a region at normal atmospheric pressure, and a third port coupled to said pneumatic actuator, said solenoid valve being operable in response to the electrical signal state at said input for selectively establishing fluid flow communication between said third port and one of said first and second ports.

6. A system as defined in claim 5 further comprising two conduits each containing a flow control orifice connected to form a fluid flow path between the two turbine chambers in parallel with a respective one of said valve units.

7. A system as defined in claim 5 wherein said actuator of each said controllable valve is connected for maintaining the respective controllable valve closed when said actuator is in communication, via said solenoid valve, with the source of air under pressure.

8. A system as defined in claim 7 further comprising two conduits each containing a flow control orifice connected to form a fluid flow path between the two turbine chambers in parallel with respective one of said valve units.

9. A system as defined in claim 7 wherein said solenoid valve for each said controllable valve is operable for establishing communication between said second and third ports of said solenoid valve when no electrical signal is present at said electrical signal input.

10. A system as defined in claim 9 further comprising two conduits each containing a flow control orifice connected to form a fluid flow path between the two turbine chambers in parallel with a respective one of said valve units.

11. In a system composed of a steam turbine including a rotor having a shaft, the turbine containing a plurality of chambers each defining a pressure zone containing a fluid which, during operation of the turbine, is at a pressure which influences the axial thrust load on the shaft, the turbine being constructed such that at least during rapid shut down a pressure differential can develop between two of the chambers to create an excessive axial thrust load on the shaft, the improvement comprising controllable valve means connected in a fluid flow path between the two chambers, valve operating means connected for operating said valve means during rapid shut down of the turbine in order to reduce the pressure differential between the two chambers, and a conduit containing a flow control orifice connected to form a fluid flow path between the two turbine chambers in parallel with said controllable valve means (30–36 ).

* * * * *